US008833080B2

(12) United States Patent
Hoffman et al.

(10) Patent No.: US 8,833,080 B2
(45) Date of Patent: Sep. 16, 2014

(54) ARRANGEMENT WITH A STEAM TURBINE AND A CONDENSER

(75) Inventors: Lawrence Hoffman, Citrus Heights, CA (US); Cheryl Lynn Hoffman, legal representative, Citrus Heights, CA (US); Scott Macadam, Bartlesville, OK (US); Udo Tielcke, Nürnberg (DE)

(73) Assignee: Clean Energy Systems, Inc., Rancho Cordova, CA (US)

( * ) Notice: Subject to any disclaimer, the term of this patent is extended or adjusted under 35 U.S.C. 154(b) by 1296 days.

(21) Appl. No.: 12/593,789

(22) PCT Filed: Mar. 31, 2008

(86) PCT No.: PCT/EP2008/053813

§ 371 (c)(1),
(2), (4) Date: Apr. 9, 2010

(87) PCT Pub. No.: WO2008/119784

PCT Pub. Date: Oct. 9, 2008

(65) Prior Publication Data

US 2010/0205965 A1 Aug. 19, 2010

Related U.S. Application Data

(60) Provisional application No. 60/921,096, filed on Mar. 30, 2007.

(51) Int. Cl.

| | |
|---|---|
| ***F01K 7/42*** | (2006.01) |
| ***F01K 7/34*** | (2006.01) |
| ***F22D 1/32*** | (2006.01) |
| ***F01K 7/38*** | (2006.01) |

(52) U.S. Cl.

CPC . *F01K 7/38* (2013.01); *F01K 7/345* (2013.01); *F01K 7/42* (2013.01); *F22D 1/32* (2013.01)

USPC ..... 60/653

(58) Field of Classification Search

USPC ..... 60/653, 661, 666

See application file for complete search history.

(56) References Cited

U.S. PATENT DOCUMENTS

| | | | | |
|---|---|---|---|---|
| 3,523,421 | A | 8/1970 | Schuetzenduebel | |
| 4,274,259 | A * | 6/1981 | Silvestri, Jr. | 60/663 |
| 6,047,549 | A | 4/2000 | Saurer et al. | |
| 6,422,017 | B1 | 7/2002 | Bassily | |
| 2004/0177614 | A1 | 9/2004 | Kumagai et al. | |

FOREIGN PATENT DOCUMENTS

| | | |
|---|---|---|
| EP | 0 122 806 A2 | 10/1984 |
| EP | 1 965 043 A1 | 9/2008 |
| RU | 2269654 C2 | 2/2006 |

* cited by examiner

*Primary Examiner* — Kenneth Bomberg
*Assistant Examiner* — Jonathan Matthias
(74) *Attorney, Agent, or Firm* — Heisler & Associates

(57) ABSTRACT

An arrangement including at least one steam turbine and one condenser is provided. Further, a method to operate such an arrangement is provided. A regenerative deheater is arranged in the steam flow between the steam turbine and the condenser, by which the steam, superheated exhaust steam, exiting the steam turbine is cooled down before entering the condenser and by which a feed-water stream is heated up.

13 Claims, 2 Drawing Sheets

ARRANGEMENT WITH A STEAM TURBINE AND A CONDENSER

CROSS REFERENCE TO RELATED APPLICATIONS

This application is the US National Stage of International Application No. PCT/EP2008/053813, filed Mar. 31, 2008 and claims the benefit thereof. The International Application claims the benefits of provisional patent application filed on Mar. 30, 2007, and assigned application No. 60/921,096. All of the applications are incorporated by reference herein in their entirety.

FIELD OF INVENTION

The present invention relates to an arrangement with at least one steam turbine and one condenser. Further the invention deals with a method to operate an arrangement according to the invention.

BACKGROUND OF INVENTION

As the public attention to the harm to the natural environment increases energy consumption with a low efficiency is more and more criticized. Especially the fossil generation of energy is in the focus of the critic since the carbon dioxide concentration in the atmosphere is increasing and is suspected to cause a green house effect. Therefore it is planed to penalize the production of carbon dioxide with so called $CO_2$-certificates. This political development increases the economic interest in technology, which enables energy production with low emission. Even stricter handled is the emissions of nitro oxides, which are suspected to cause even more serious damage to the natural environment.

In this context the efficiency of cogeneration, in particular the efficiency of an arrangement with a steam turbine and a condenser becomes extremely interesting as this arrangement is one of the most powerful devices to generate energy out of heat, which often is a waste product of a higher ranking process. A very important issue is to keep the cogeneration very flexible with regard to the thermodynamic boundary conditions to reach always the highest efficiency possible.

One example for an environmental-friendly cogeneration is the energy and heat generation using oxyfuel. Purified oxygen is mixed with a fuel, in particular with methane and burned under a pressure of proximately 30 bar and in an atmosphere of exhaust gas, which was fed back to obtain a high concentration of carbon dioxide, which afterwards is purified and liquefied. This very special process has several constraints and the waste heat has therefore very specific thermodynamic parameters, which make it difficult to set up a highly efficient cogeneration with a steam turbine.

In the U.S. Pat. No. 6,047,549 B1 a power plant facility is described combining a gas turbine with a waste heat boiler in flow connection with a condensing steam turbine. In this arrangement the gas turbine, the waste heat boiler and the steam turbine are finally tuned to each other and therefore reach efficiencies of up to 58%. The term "waste" can not really be applied to the heat of the exhaust gas of the gas turbine since the gas turbine was designed from the beginning on to supply this heat to the boiler, which is generating steam for the steam turbine. So far, no concept is known to use waste heat not having proper conditions to operate a steam turbine with a high efficiency.

SUMMARY OF INVENTION

Therefore it is an object of the invention to design an arrangement with a steam turbine and a condenser having a high efficiency even with improper conditions of the waste heat respectively of the steam generated by the application of the waste heat.

It is a further object of the invention to increase the flexibility of the cogeneration using a steam turbine and a condenser and to obtain increased efficiencies even with improper thermodynamic parameters of the waste heat.

This object is achieved by an incipiently mentioned type of arrangement with a regenerative deheater arranged in the steam flow between the steam turbine and the condenser, by which the steam existing the steam turbine is cooled down before entering the condenser and by which a feed-water stream is heated up.

This arrangement solves the problem of inflexibility with respect to the thermodynamic conditions of the operation of a steam turbine by allowing the exhaust steam of the steam turbine to be superheated but recovering the energy surplus of the superheated steam during a heat exchange in the regenerative deheater, which feeds back this heat energy to the beginning of the thermal cycle. An additional advantage of the arrangement according to the invention is, that the blading of the steam turbine is not exposed to wet steam, which normally leads to erosion damages of the blades. An extra advantage of the object of the invention is that the condenser is also not exposed to the superheated steam due to the regenerative deheater and therefore is needs also not to be reinforced to cope with the high energy and higher temperatures. Without any loss due to mixing-enthalpy one embodiment of the present invention suggests, that the total mass flow of the steam exiting the steam turbine enters the regenerative deheater. With a sufficient size of the regenerative deheater the pressure loss becomes tolerable and the arrangement can be operated over a large range of thermal conditions. The flexibility of the operation of the arrangement according to the invention is increased, when parallel to the regenerative deheater at least one bypass for the feed-water stream is arranged so that feed-water can bypass the regenerative deheater and does not participate in energy exchange between feed-water and steam exiting the steam turbine. The operating range with a good efficiency is enlarged, when at least one valve is arranged at the intersection between the bypass line and the feed-water stream entering the regenerative deheater, by which valve the ratio between the feed-water stream entering the regenerative deheater and the feed-water stream bypassing the regenerative deheater can be controlled. This control can automatically be done by a control unit, which is designed in such a manner that the proportion between the feed-water streams entering the regenerative deheater and bypassing the regenerative deheater is controlled in dependency on a temperature of the steam between the exit of this steam turbine and the inlet of the condenser. By this control the arrangement of the steam turbine, the condenser, deheater and the valve controlling the ratio of bypass flow and flow of feed-water through the deheater the arrangement more or less adjusts automatically to changing wasted energy supply and keeps up to a high efficiency.

The arrangement according to the invention can be combined with advantage with a boiler by which the feed-water is heated respectively superheated, before entering steam turbine, wherein the boiler is designed in such a manner, that it is heated by a mixture of oxygen and fuel in particular by a mixture of oxygen and hydrocarbonate. This mixture, which also is called oxyfuel, generates a mixture of 85% water and 15% carbon dioxide, when it is burned together with fed bag exhaust a gas. The "oxyfuel"-process gives the thermodynamic circle of the steam turbine strong constrains so that the application can beneficially be applied.

The invention relates not only to the arrangement of a steam turbine, a condenser and a regenerative deheater in-between but also to a method to operate this arrangement.

BRIEF DESCRIPTION OF THE DRAWINGS

The above mentioned attributes and other features and advantages of this invention and the manner of attaining them, will become more apparent and the invention itself will be better understood by reference to the following description of embodiments of the invention taken in conjunction with the accompanying drawing, wherein.

DETAILED DESCRIPTION OF INVENTION

Figure 1:
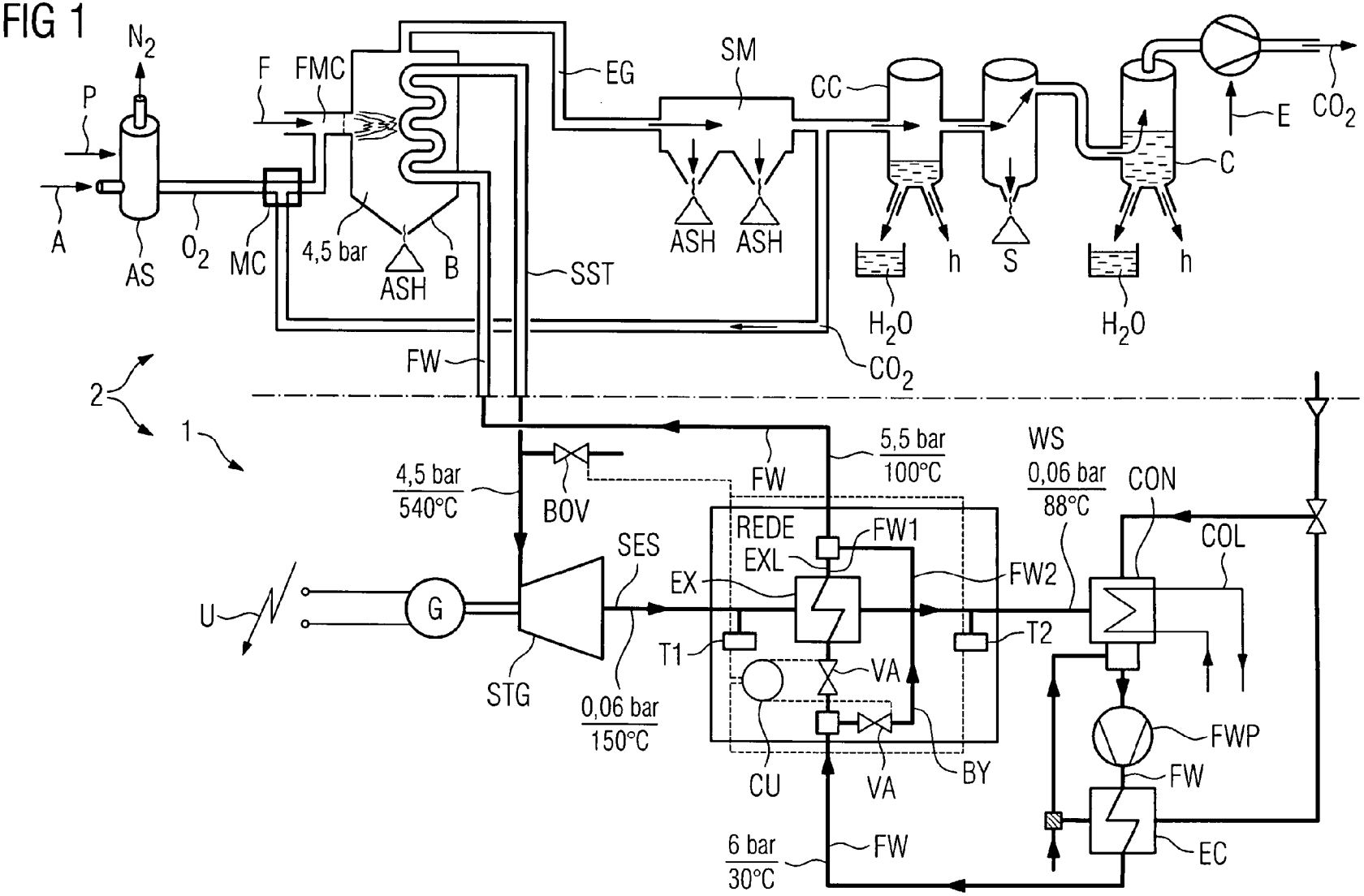
FIG. 1 shows a schematic flow sheet of an oxyfuel power plant comprising the arrangement according to the invention.

FIG. 1 shows a schematic flow diagram of an arrangement 1 according to the invention implemented into a power plant facility 2. The power plant facility 2 consumes air A and fuel F and generates carbon dioxide $CO_2$ and electricity U.

Beginning in the upper left of the diagram air A enters an air separation AS, which separates the nitrogen $N_2$ from the oxygen $O_2$ consuming electrical energy P. The oxygen $O_2$ is mixed with $CO_2$ in a mixing chamber MC and enters a fuel mixing chamber FMC, where the mixture of O2 and CO2 is mixed with fuel F, which preferably consists of methane $CH_4$. The nitrogen $N_2$, which was separated from the air is compressed and liquefied, which is not shown in the diagram.

The mixture of FMC of fuel F, oxygen O2 and carbon dioxide CO2 is burned in a boiler B under a pressure of 4.5 bar. The exhaust gas EG of the burning process loses in first instance bigger particles of ash and in the following separation module SM finer particles of ash. After the ash separation in the separation module SM a part of the exhaust gas EG, which is mainly CO2, is fed bag to the mixing chamber MC, where it is mixed with oxygen O2. The other part of the exhaust gas EG, respectively $CO_2$, is supplied into a cooler- and condenser-module CC, where water $H_2O$ and heat h is removed. In the following separator SS solver S is removed and the remaining exhaust gas EG respectively purified CO2 is again supplied to a cooler C, where again heat h and water $H_2O$ is removed. Finally the pure CO2 is compressed by a compressor CO consuming energy E. The compressed and preferably liquefied CO2 is finally stored in a safe storage system, for example pumped into a submontane cavity.

The boiler B heats up feed-water FW and generates superheated steam SST by burning the mixture of FMC. The feed-water FW is supplied to boiler B at approximately 5.5 bar and 100° C. and the superheated steam SST is delivered by the boiler at a pressure of approximately 5.4 bar and 540° C. The superheated steam SST enters a steam turbine STG, which drives a generator G, generating electrical energy U. After exiting the steam turbine STG the superheated steam SST has a pressure of 0.06 bar and a temperature of 150° C. and is therefore still superheated. The depiction of the steam turbine STG is highly simplified and would in most cases comprise more than one turbine casing operating at different inlet and outlet steam pressures and temperatures. In most cases also the boiler would be constructed in a much more complex manner and comprise several connections to the steam turbine STG, for example for reheating, in particular intermediate superheating.

The superheated exhaust steam SES exiting the steam turbine STG enters a regenerative deheater REDE according to the invention.

After exiting the regenerative deheater REDE the superheated steam SES becomes wet steam WS at a pressure of approximately 0.06 bar and a temperature of 88° C. Entering a condenser CON, which is cooled by a coolant COL, for example water, and where the wet steam condenses to feed-water FW. The feed-water is pumped by a feed-water pump FWP after a passage through an ejector condenser EC and delivered to the regenerating deheater at a pressure of approximately 6 bar and a temperature of approximately 30° C. In the regenerative deheater REDE the feed-water FW is heated up and supplied to the boiler B.

The whole mass flow of the superheated exhaust steam SES is conveyed through the regenerative deheater REDE and exchanges energy with the feed-water FW or at least a part-flow of the feed-water FW. The feed-water stream is separated in a first stream FW1, receiving heat energy from the superheated exhaust steam SES and a second stream FW2 bypassing the internal heat exchanger EX of the regenerative deheater REDE. The separation is done by the valve arrangement VA controlling the mass flow of the feed-water FW through the bypass BY, bypassing the heat exchange line EXL. Before entering the boiler B the feed-water streams FW1, FW2 are mixed again. The valve arrangement FA and the division of the feed-water flow are controlled by a control unit CU, which controls the positions of the valves of the valve arrangement VA in dependency on the temperature of the superheated exhaust steam SES and the wet steam WS in front of the regenerative deheater REDE respectively behind the regenerative deheater REDE. Further, the control unit CU controls the position of a blow-off-valve VOV especially during start-up-processes.

Figure 2:
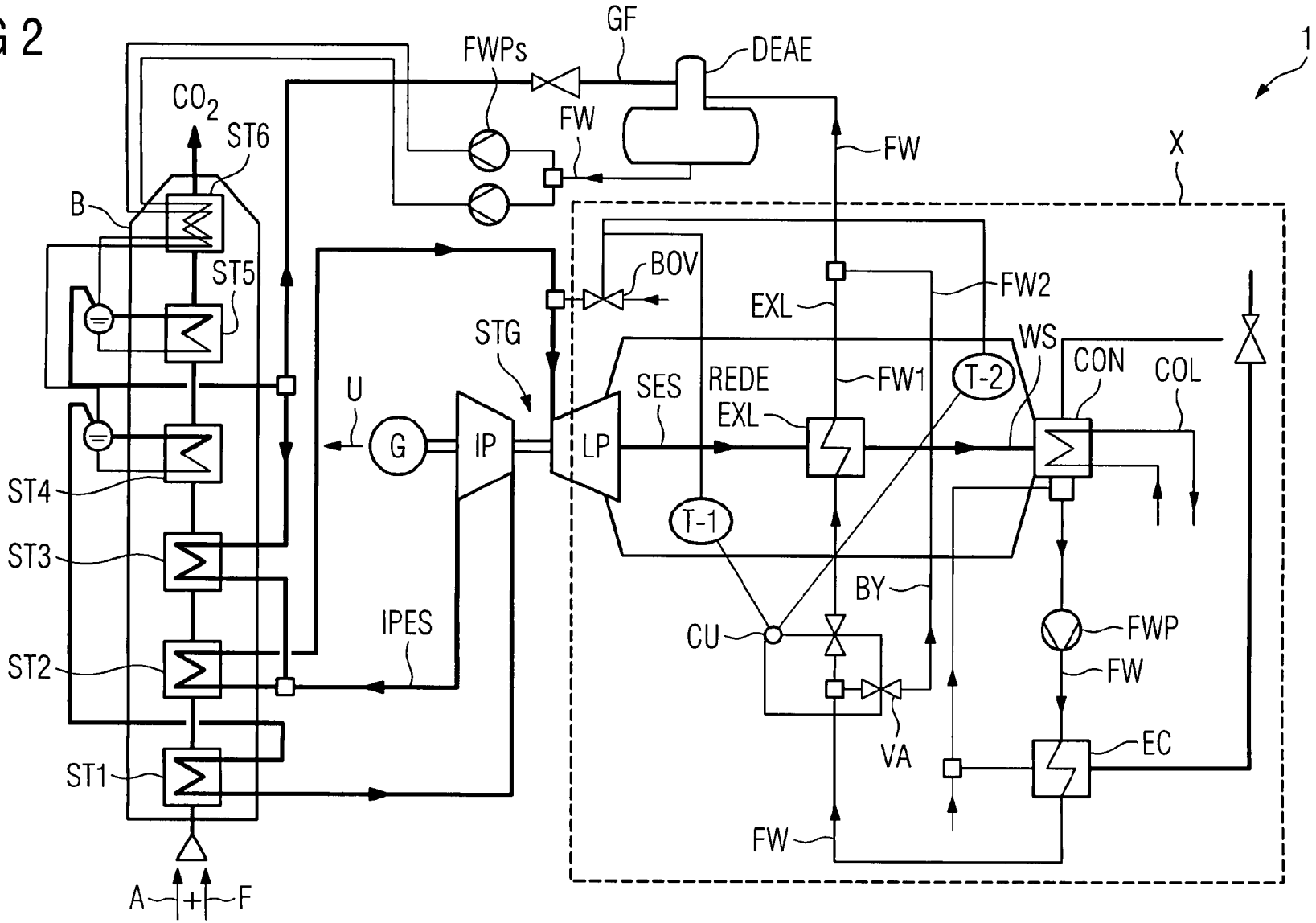
FIG. 2 shows a schematic flow sheet of a conventional steam turbine power plant comprising the arrangement according to the invention.

FIG. 2 shows a schematic flow sheet of a conventional steam turbine power plant comprising an arrangement according to the invention. The arrangement according to the invention is the same as shown in FIG. 1 and is framed by a dotted line X. In this embodiment the steam turbine STG comprises two turbine casings IP, LP, wherein the average pressure in the first casing IP is higher than in the second casing LP. The steam SES exiting the second casing LP is superheated. FIG. 2 shows also a boiler B in a more complex manner than FIG. 1, which depiction is still simplified.

Air A and fuel F enters the boiler B and is burned in several stages ST1 to ST6 generating heat and exhaust gas $CO_2$ containing also further chemical components, which are in most cases undesired, for example acids. The temperature in the boiler B is decreasing from the highest temperature in stage one ST1 to the lowest temperature in stage six ST6. Stage six ST6 is operated as a feed-water FW preheater and the stages four and five ST5 are operated as steam generators, where the preheated feed-water FW is evaporated. The evaporated feed-water FW enters stage one ST1 and is superheated to the highest temperature available and to enter afterwards the first turbine casing IP. After converting thermal energy into mechanical energy in the first casing IP the exhaust steam IPS enters stage two ST2 of the boiler B, where it is reheated. The resulting reheat steam REST has a pressure of approximately 426 bar and a temperature of approximately 500-560° C. The reheated steam REST enters with the superheated conditions the second turbine casing LP and is expanded to generate mechanical energy, which is converted by the generator GEN into electrical energy U. The steam exiting the second turbine casing LP is superheated exhaust steam SES and enters the regenerative deheater ReDe as described previously.

As a supplementation to the embodiment in FIG. 1, FIG. 2 shows that the feed-water FW leaves the regenerative deheater ReDe with a temperature of approximately 70-90° C. and enters a deaerator DEAE, where the feed-water FD is degasified respectively purified from foreign gases. The gas is calcinated out of the feed-water by heating the feed-water using the steam from stage five ST5.

While the present invention has been described as having a preferred design, it can be further modified within the spirit and the scope of this disclosure. This application is therefore intended to cover any variations, uses or adoptions of the invention using its general principles. Further, this application is intended to cover such departures from the present disclosure as come with a known or customer practice in the art to which this invention pertains.

The invention claimed is:

1. An arrangement, comprising:

a steam turbine;

a condenser; and a regenerative deheater, wherein the regenerative heater is arranged in a steam flow between the steam turbine and the condenser, wherein the regenerative heater cools down a steam exiting the steam turbine before entering the condenser, and wherein the regenerative heater heats up a feed-water stream, and wherein a bypass is arranged in parallel to the regenerative deheater so that a portion of the feed-water stream can bypass a heat exchanger of the regenerative deheater and whereby an energy exchange between the portion of the feed-water stream and the steam exiting the steam turbine does not occur, wherein a valve is arranged at an intersection between the bypass line and the feed-water stream entering the regenerative deheater, and wherein the valve separates the feed water into a first proportion of the feed-water stream entering the regenerative deheater and a second proportion of the feed-water stream bypassing the regenerative deheater.

2. The arrangement as claimed in claim 1, wherein a total mass flow of the steam exiting the steam turbine enters the regenerative deheater.

3. The arrangement as claimed in claim 2, wherein the steam exiting the steam turbine is superheated.

4. The arrangement as claimed in claim 1, wherein the first proportion of feed water and the second proportion of feed water are joined together again before entering a boiler.

5. The arrangement as claimed in claim 1, wherein a boiler heats the feed-water and generates superheated steam before entering the steam turbine, and wherein the boiler is heated by a mixture of oxygen and a fuel.

6. The arrangement as claimed in claim 5, wherein the boiler is heated by the mixture of oxygen and a hydrocarbonate.

7. The arrangement as claimed in claim 1, wherein the steam turbine includes two turbine casings, and wherein a first average pressure in a first casing is higher than a second average pressure in a second casing, and wherein the steam exiting the second casing is superheated.

8. The arrangement as claimed in claim 1, wherein the steam is at a pressure of 0.06 bar and a temperature of 88° C. after exiting the regenerative deheater.

9. A method for operating an arrangement with a steam turbine and a condenser, comprising:

cooling down a steam exiting the steam turbine by a regenerative deheater, and heating up a feed-water in the regenerative deheater using a thermal energy of the steam, wherein a bypass is arranged in parallel to the regenerative deheater so that a portion of a feed-water stream can bypass a heat exchanger of the regenerative deheater, wherein a valve arranged between a first feed-water stream entering the regenerative deheater and a second feed-water stream bypassing the regenerative deheater is controlled depending on a first steam temperature located at an exit of the steam turbine and a second steam temperature located at an inlet of the condenser.

10. The method as claimed in claim 9, wherein a total mass flow of the steam exiting the steam turbine enters the regenerative deheater.

11. The method as claimed in claim 10, wherein the steam exiting the steam turbine is superheated.

12. The method as claimed in claim 9, wherein the steam entering the steam turbine is generated using a mixture of fuel and oxygen.

13. The method as claimed in claim 12, wherein the steam entering the steam turbine is generated using a mixture of oxygen and a hydrocarbonate.

* * * * *